US008752953B2

(12) United States Patent
Tanaka et al.

(10) Patent No.: US 8,752,953 B2
(45) Date of Patent: Jun. 17, 2014

(54) IMAGE FORMING APPARATUS

(75) Inventors: Akiyoshi Tanaka, Kanagawa (JP); Yoichi Ito, Tokyo (JP); Kuniyori Takano, Kanagawa (JP); Hideaki Iijima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

(21) Appl. No.: 13/286,417

(22) Filed: Nov. 1, 2011

(65) Prior Publication Data

US 2012/0113204 A1 May 10, 2012

(30) Foreign Application Priority Data

Nov. 9, 2010 (JP) ..... 2010-250999

(51) Int. Cl.
*B41J 2/01* (2006.01)

(52) U.S. Cl.
USPC ..... 347/104; 347/101

(58) Field of Classification Search
USPC ..... 347/8, 16, 19, 27, 34, 104, 101
See application file for complete search history.

(56) References Cited

U.S. PATENT DOCUMENTS

| | | | | |
|---|---|---|---|---|
| 7,591,551 | B2 | 9/2009 | Imoto et al. | |
| 7,682,016 | B2 | 3/2010 | Sakuma et al. | |
| 2002/0030706 | A1 * | 3/2002 | Nakanishi et al. | 347/8 |
| 2005/0019067 | A1 * | 1/2005 | Kang et al. | 399/306 |
| 2007/0109386 | A1 * | 5/2007 | Mohri et al. | 347/104 |
| 2009/0073213 | A1 * | 3/2009 | Iwata | 347/19 |
| 2011/0109692 | A1 | 5/2011 | Ito et al. | |
| 2011/0141181 | A1 | 6/2011 | Ito et al. | |

FOREIGN PATENT DOCUMENTS

| | | | |
|---|---|---|---|
| JP | 2000-1010 | | 1/2000 |
| JP | 2001-287873 | | 10/2001 |
| JP | 2004-345847 | | 12/2004 |
| JP | 2006-232440 | * | 7/2006 |
| JP | 2006-213480 | | 8/2006 |
| JP | 2006-232440 | | 9/2006 |

OTHER PUBLICATIONS

U.S. Appl. No. 13/224,436, filed Sep. 2, 2011.
U.S. Appl. No. 13/238,034, filed Sep. 21, 2011.
U.S. Appl. No. 13/286,426, filed Nov. 1, 2011.

* cited by examiner

*Primary Examiner* — Manish S Shah
*Assistant Examiner* — Yaovi Ameh
(74) *Attorney, Agent, or Firm* — Cooper & Dunham LLP

(57) ABSTRACT

An image forming apparatus includes a recording head, a conveyance belt, a charger, a reverse passage, and an auxiliary conveyance roller. The belt is looped around at least two rollers to adhere a recording medium thereto by electrostatic force and convey the medium. The belt defines a normal conveyance area in which the medium is conveyed in a first direction. The reverse passage delivers the medium turned around in an area downstream from the belt in the first direction and sends the medium back again to a portion of the belt upstream from the head in the first direction. The reverse passage includes an opposite conveyance area of the belt in which the medium is conveyed in a second direction opposite the first direction. The auxiliary conveyance roller is disposed at least one of an entry part and an exit part of the opposite conveyance area.

7 Claims, 11 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2010-250999, filed on Nov. 9, 2010, in the Japanese Patent Office, the entire disclosure of which is hereby incorporated by reference herein.

TECHNICAL FIELD

This disclosure relates to an image forming apparatus, and more specifically to an image forming apparatus including a recording head for ejecting liquid droplets.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head) for ejecting droplets of ink. During image formation, such liquid-ejection-type image forming apparatuses eject droplets of ink or other liquid from the recording head onto a recording medium to form a desired image.

Such liquid-ejection-type image forming apparatuses fall into two main types: a serial-type image forming apparatus that forms an image by ejecting droplets from the recording head while moving the recording head in a main scanning direction of the carriage, and a full-line-type image forming apparatus that forms an image by ejecting droplets from a linear-shaped recording head held stationary in the image forming apparatus.

Conventionally, as one type of image forming apparatus that conveys a recording medium by a conveyance belt, for example, JP-2006-232440-A proposes an image forming apparatus including an image forming engine to form an image on a recording medium, a recording-medium conveyance belt disposed opposing the image forming engine to circulate to convey the recording medium, and a return conveyance passage to return the recording medium having an image recorded on the first face by the image forming engine to an upstream side of the image forming engine for duplex printing. In the recording-medium conveyance belt, a returning part for moving the recording medium in a direction that is the reverse of a normal conveyance direction is arranged on a part of the return conveyance passage, and the recording medium is return-conveyed by the returning part. In addition, a bypass passage is provided separately from the recording-medium conveyance belt so as to start from an exit of the return part in the moving direction of the recording medium. The recording medium is returned via the bypass passage onto a part of the conveyance belt moving in the normal conveyance direction.

Similarly, JP-2006-213480-A proposes a recording device including a recording section to eject ink to a recording medium, a conveyance unit to send a recording medium having an image recorded by the recording unit back to an upstream side in a conveyance direction of the recording medium, and a reversing unit disposed downstream from the conveyance unit in a return direction of the recording medium and having a plurality of holding parts to hold a non-recorded face of the recording medium sent back by the conveyance unit, turn around the recording medium, and send the recording medium to the recording section.

In JP-2006-232440-A, a charger is disposed near an entry of the conveyance belt into the return conveyance passage in the moving direction of the recording medium and within a loop of the conveyance belt so as to charge the conveyance belt from the inner surface side of the conveyance belt. However, for such a conveyance unit that charges the conveyance belt to convey the recording medium with the recording medium attached to and held on the conveyance belt by electrostatic force, separation of the recording medium from the conveyance belt can cause the electrostatic adhesion force to decrease or decay. As a result, when the recording medium is sent back again onto the conveyance belt, the recording medium may not adhere properly to the conveyance belt. In addition, in JP-2006-213480-A, the recording medium is sent back with the recording medium adhering to the conveyance belt by electrostatic force and turned around by the reversing unit disposed downstream in the return direction. As a result, when the recording medium is sent to a return point of the conveyance belt, the recording medium tends to be separated from the conveyance belt, thus hampering stable reverse conveyance.

Similar problems attend the art described in JP-2006-232440-A. When the recording medium is sent to the bypass passage from the conveyance belt charged near the entry of the conveyance belt into the return conveyance passage, the recording medium is separated from the conveyance belt and the electrostatic adhesion force of the conveyance belt decays. As a result, when the recording medium is once more sent back onto the conveyance belt, the recording medium does not properly adhere to the conveyance belt, thus hampering stable reverse conveyance.

In addition, as described above, in the case in which the recording medium is reversely conveyed (conveyed while being turned over) with a portion of the conveyance belt, the recording medium must be reliably adhered to the conveyance belt. However, in the arts described in JP2006-213480-A and JP2006-232440-A, the recording medium is simply sent back again to the conveyance belt or conveyed with the recording medium adhered to the conveyance belt. As a result, the recording medium may not reliably adhered to the conveyance belt, thus hampering stable reverse conveyance.

BRIEF SUMMARY

In an aspect of this disclosure, there is provided an improved image forming apparatus including a recording head, a conveyance belt, a charger, a reverse passage, and an auxiliary conveyance roller. The recording head has a nozzle face in which nozzles to eject liquid droplets are disposed. The conveyance belt is looped around at least two rollers to adhere a recording medium thereto by electrostatic force and convey the recording medium. The conveyance belt defines a normal conveyance area in which the recording medium is conveyed in a first conveyance direction with the recording medium facing the recording head. The charger is disposed to charge a surface of the conveyance belt. The reverse passage delivers the recording medium turned around in an area downstream from the conveyance belt in the first conveyance direction after the recording head forms an image on a first face of the recording medium in duplex printing, and sends the recording medium back again to a portion of the conveyance belt upstream from the recording head in the first conveyance direction. The reverse passage includes an opposite conveyance area of the conveyance belt in which the recording medium is conveyed in a second conveyance direction opposite the first conveyance direction. The auxiliary conveyance roller is disposed at least one of an entry part and an exit part of the opposite conveyance area of the conveyance belt.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
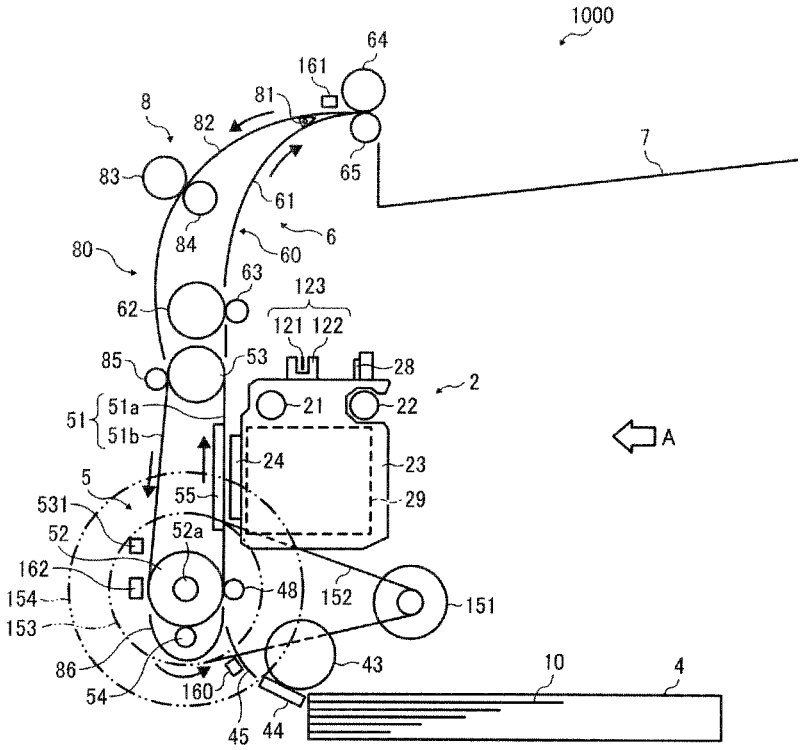
FIG. 1 is a side view of a mechanical section of an image forming apparatus according to a first exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images, such as characters and figures, but meaningless images, such as patterns, to the medium and simply landing liquid droplets on the medium. The term "ink" used herein is not limited to "ink" in a narrow sense and includes anything usable for image formation, such as recording liquid, fixing treatment liquid, liquid, and resin. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to a first exemplary embodiment of this disclosure is described with reference to FIGS. 1 and 2.

FIG. 1 is a schematic side view of a mechanical section of the image forming apparatus. FIG. 2 is a side view of the mechanical section seen from a direction indicated by an arrow A of FIG. 1.

In this exemplary embodiment, an image forming apparatus 1000 is a serial-type image forming apparatus including an image forming section 2, a sheet feed tray 4, a conveyance mechanism section 5, a sheet output section 6, and a sheet output tray 7. At a lower portion of the image forming apparatus 1000, the sheet feed tray 4 (serving as a sheet feed section including a sheet feed cassette) is disposed to load multiple sheets 10 serving as recording media. The sheets 10 are fed sheet by sheet from the sheet feed tray 4 to the conveyance mechanism section 5. While intermittently conveying the sheet 10 in a vertical direction by the conveyance mechanism section 5, the image forming section 2 ejects liquid droplets in a horizontal direction to record a desired image. After image formation, the sheet 10 having the image thereon is further conveyed upward in the vertical direction and output to the sheet output tray 7 at an upper portion of the image forming apparatus 1000.

In duplex printing, after a first face (top face) of the sheet 10 is printed, the sheet 10 is sent from the sheet output section 6 into a sheet reverse section 8. In the sheet reverse section 8, the sheet 10 is turned around while being conveyed in the opposite direction (e.g., downward in the vertical direction in FIG. 1). As a result, the sheet 10 is sent again to the conveyance mechanism section 5 in a state in which a second face (bottom face) of the sheet 10 is printable. After the second face of the sheet 10 is printed, the sheet 10 is output to the sheet output tray 7.

Figure 2:
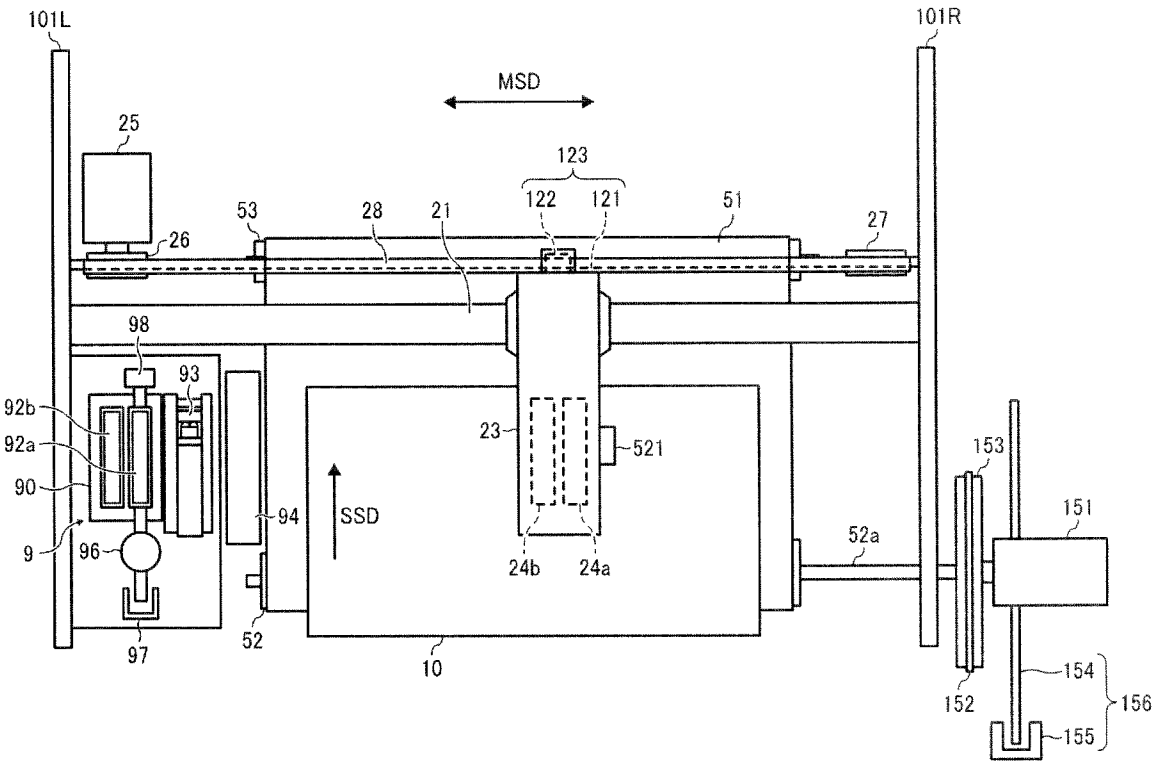
FIG. 2 is a side view of the mechanical section seen from a direction indicated by arrow A in FIG. 1.

In the image forming section 2, as illustrated in FIG. 2, a carriage 23 mounting at least one recording head 24 is slidably supported by a main guide member 21 and a sub guide member 22 extended between a left side plate 101L and a right side plate 101R. A main scanning motor 25 moves the carriage 23 for scanning in a main scanning direction (indicated by an arrow MSD in FIG. 2) via a timing belt 28 looped between a driving pulley 26 and a driven pulley 27.

On the carriage 23, for example, recording heads 24*a* and 24*b* (referred to as "recording heads 24" unless distinguished) are mounted to eject ink droplets of, e.g., yellow (y), magenta (m), cyan (c), and black (k). The recording heads 24 having multiple nozzle rows are mounted on the carriage 3 so that multiple nozzles of each of the nozzle rows are arrayed in lines in a direction (sub scanning direction indicated by an arrow SSD in FIG. 2) perpendicular to the main scan direction MSD and ink droplets are ejected from the nozzles in the horizontal direction. In other words, the image forming apparatus 1000 employs a horizontal ejection method in which a nozzle face 124 having multiple nozzles in each recording head 24 is oriented in the vertical direction to eject liquid droplets in the horizontal direction.

Figure 3:
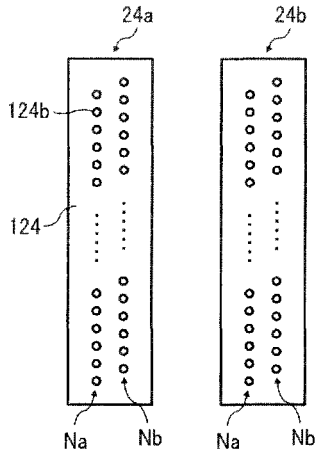
FIG. 3 is an enlarged view of recording heads of the image forming apparatus.

As illustrated in FIG. 3, each of the recording heads 24 includes two nozzle rows Na and Nb each having multiple nozzles 124*b* arranged in line. For example, the recording head 24*a* ejects yellow (Y) droplets from the first nozzle row Na of the two nozzle rows and magenta (M) droplets from the second nozzle row Nb of the nozzle rows, and the recording head 24*b* ejects black (K) droplets from the first nozzle row Na of the nozzle rows and cyan (C) droplets from the second nozzle row Nb of the nozzle rows.

As pressure generators to generate pressure to eject droplets, liquid ejection heads constituting the recording heads 24 may employ, for example, piezoelectric actuators such as piezoelectric elements, thermal actuators that generate film boiling of liquid (ink) using electro-thermal transducers such as heat-generation resistant to cause a phase change, shape-memory-alloy actuators to change a metal phase by a temperature change, or electrostatic actuators that generate pressure by electrostatic force. The carriage 23 may mount liquid ejection heads for ejecting, e.g., fixing solution that can enhance the fixing performance of ink by reacting the ink.

The carriage 23 further mounts head tanks 29 to supply different color inks to the corresponding nozzle rows Na and Nb of the recording heads 24. The head tanks 29 receive the respective color inks from corresponding ink cartridges (main tanks) removably mounted in a main unit of the image forming apparatus 1000.

The image forming apparatus 1000 includes a linear encoder (main scanning encoder) 123 to detect movement of the carriage 23. The linear encoder 123 includes an encoder scale 121 and a first encoder sensor 122. The encoder scale 121 with a predetermined pattern extends in the main scanning direction MSD of the carriage 23 between the left side plate 101L and the right side plate 101R. The first encoder sensor 122 is, e.g., a transmissive photosensor and is provided at the carriage 23 to read the pattern of the encoder scale 121.

In FIG. 2, at a non-print area on one end in the main-scanning direction MSD of the carriage 23 is disposed a maintenance unit 9 to maintain and recover conditions of the nozzles 124*b* of the recording head 24. The maintenance unit 9 includes a first cap member 92*a*, a second cap member 92*b*, a wiping member (wiping blade) 93, and a first droplet receptacle 94. The first cap member 92*a* and the second cap member 92*b* (hereinafter collectively referred to as "cap members 92" unless distinguished) seal the nozzle faces 124 of the recording head 24*a* and the recording head 24*b*, respectively. The wiping member (wiping blade) 93 wipes the nozzle faces 124 of the recording heads 24. The first droplet receptacle 94 stores, e.g., viscosity-increased ink ejected during preliminary ejection (maintenance ejection). The first cap member 92*a* is connected to a suction pump 96 serving as a suction device, and the suction pump 96 is connected to a waste liquid tank 97. The cap member 92*a* forms a sealed space when sealing the nozzle face 124 of the recording head 24*a* and has an air release valve 98 to open the sealed space to ambient air.

The sheets 10 on the sheet feed tray 4 are separated by a sheet feed roller 43 and a separation pad 44 and sent sheet by sheet to the main unit of the image forming apparatus 1000. Further, the sheet 10 is sent along a conveyance guide member 45 to between a conveyance belt 51 and a press roller 48 in the conveyance mechanism section 5, adhered onto the conveyance belt 51, and conveyed by the conveyance belt 51.

The conveyance mechanism section 5 includes the conveyance belt 51 of endless shape looped between a conveyance roller 52 serving as a driving roller and a driven roller 53, a charge roller 54 serving as a charger to charge the conveyance belt 51, and a platen member 55 to maintain the conveyance belt 51 in a flat state at an area facing the image forming section 2.

The conveyance roller 52 is rotated by a sub scanning motor 151 via a second timing belt 152 and a timing pulley 153. The rotation of the conveyance roller 52 causes the conveyance belt 12 to circulate in a sheet conveyance direction (the sub scanning direction SSD).

The conveyance belt 51 has a normal conveyance area 51*a* and an opposite conveyance area (reverse conveyance area) 51*b*. The normal conveyance area 51*a* is an area from the conveyance roller 52 to the driven roller 53 that faces the image forming section 2 to convey the sheet 10 in a first conveyance direction (normal conveyance direction) with the sheet 10 adhered to the conveyance belt 51. The opposite conveyance area 51*b* is an area from the driven roller 53 to the conveyance roller 52 that is disposed at a position opposing the normal conveyance area 51*a* to convey the sheet 10 in a second conveyance direction (reverse conveyance direction or opposite conveyance direction) opposite the normal conveyance direction.

The image forming apparatus 1000 further includes a rotary encoder (sub scanning encoder) 156 to detect the moving distance and position of the conveyance belt 51. The rotary encoder 156 includes a code wheel 154 and a second encoder sensor 155. The code wheel 154 with a predetermined pattern is mounted on a shaft 52*b* of the conveyance roller 52. The second encoder sensor 155 is, e.g., a transmissive photosensor to detect the pattern of the code wheel 154.

The sheet output section 6 has a sheet output roller 64, a spur 65, and a sheet output guide member 61 forming a sheet output passage 60. The sheet 10 having an image formed is output from between the sheet output roller 64 and the spur 65 to the sheet output tray 7 in a face-down manner.

The sheet reverse section 8 has a reverse passage 80 to send the sheet 10, which is partially output to the sheet output tray 7, back to between the conveyance belt 51 and the press roller 48 while turning the sheet 10 around in a switchback manner. The sheet reverse section 8 also has a switching claw 81 to switch the sheet output passage 60 and the reverse passage 80. The reverse passage 80 includes a reverse-conveyance guide member 82, the opposite conveyance area 51*b* of the conveyance belt 51 to adhere the sheet 10 sent from the reverse-conveyance guide member 82 by electrostatic force and convey the sheet 10 in the opposite conveyance direction, and a bypass guide member 86 (hereinafter also referred to as "bypass passage") to send (guide) the sheet 10 separated from the opposite conveyance area 51*b* to between the normal conveyance area 51*a* and the press roller 48.

At the reverse passage 80, a first reverse roller 83 and a spur 84 are disposed so as to sandwich the reverse-conveyance guide member 82, and an auxiliary conveyance roller 85 is disposed opposing the driven roller 53 to press the sheet 10 toward the opposite conveyance area 51*b* of the conveyance belt 51.

Between the bypass passage 86 and an outer surface of the conveyance belt 51, the charge roller 54 for charging the outer surface of the conveyance belt 51 is disposed at a position opposing the conveyance roller 52.

In this exemplary embodiment, at an area of the conveyance guide member 45 between the sheet feed section 4 and the image forming section 2 is disposed a registration sensor 160 serving as a first detector to detect the front and rear edges of the sheet 10. A reverse sensor 161 for detecting the rear edge of the sheet 10 is disposed downstream from the switching claw 81 in a direction (sheet output direction) which the sheet 10 is output toward the sheet output tray 7. A conveyance sensor 162 serving as a second detector to detect the front edge of the sheet 10 is disposed at an entry area in which the sheet 10 enters from the opposite conveyance area 51*b* of the conveyance belt 51 to the bypass passage 86.

In the image forming apparatus 1000 having the above-described configuration, the sheet 10 is separately fed from the sheet feed tray 4, is adhered to the conveyance belt 51 charged by the charge roller 54, and conveyed in the vertical direction by the circulation of the conveyance belt 51. By driving the recording heads 24 in accordance with image signals while moving the carriage 23, ink droplets are ejected onto the sheet 10 temporarily stopped to form one band of a desired image. Then, the sheet 10 is fed by a certain distance to prepare for recording another band of the image. After the recording of the image is completed, the sheet 10 is output to the sheet output tray 7.

In performing maintenance and recovery operation of the nozzles 124*b* of, e.g., the recording head 24*a*, the carriage 23 is moved to a home position opposing the maintenance unit 9 and maintenance and recovery operation, such as nozzle suctioning and preliminary ejection are performed. In nozzle suctioning, with the nozzles 124*b* sealed with the cap member 92*a*, the suction pump 96 suctions ink from the nozzles 124*b* and outputs ink to the waste tank 97. In preliminary ejection, as described above, liquid droplets not contributing to a resultant image are preliminarily ejected from the nozzles. Such maintenance and recovery operation allows stable droplet ejection for image formation.

In duplex printing, when the first face of the sheet 10 is printed as described above and the rear edge of the sheet 10 passes a branching section (the switching claw 81), the sheet output roller 64 is rotated in reverse to convey the sheet 10 in the switchback manner. Further, the sheet 10 is guided toward the reverse-conveyance guide member 82, conveyed to between the reverse roller 83 and the spur 84, and sent into between the opposite conveyance area 51*b* of the conveyance belt 51 and the auxiliary conveyance roller 85.

At this time, because the auxiliary conveyance roller 85 is disposed opposing the driven roller 53 at the entry area of the opposite conveyance area 51*b* of the conveyance belt 51, the sheet 10 conveyed in the reverse conveyance direction can be reliably adhered to the conveyance belt 51, thus allowing stable reverse conveyance. The auxiliary conveyance roller 85 can also perform registration of the sheet 10, thus allowing more stable reverse conveyance.

The sheet 10 sent into between the opposite conveyance area 51*b* and the auxiliary conveyance roller 85 is adhered to the conveyance belt 51 by electrostatic force, conveyed by the circulation of the conveyance belt 51, separated from the conveyance belt 51 at the conveyance roller 52, guided and turned over by the bypass guide member 86 (along the bypass passage), sent into between the normal conveyance area 51*a* of the conveyance belt 51 and the press roller 48, adhered to the conveyance belt 51, and conveyed again to a recording area in which image formation is performed by the recording heads 24. After the second face of the sheet 10 is printed, the sheet 10 is output to the sheet output tray 7.

As described above, because the charge roller 54 is disposed inside the bypass passage (bypass guide member) 86, when the sheet 10 separated from the opposite conveyance area 51*b* bypasses along the bypass passage 86, the conveyance belt 51 is charged again by the charge roller 54.

Thus, even in a case in which electrostatic adhesion force decays of the sheet 10 separated from the opposite conveyance area 51*b* of the conveyance belt 51, when the sheet 10 is sent into between the normal conveyance area 51*a* and the press roller 48, the sheet 10 is reliably adhered to the normal conveyance area 51*a* of the conveyance belt 51.

As described above, in this exemplary embodiment, the image forming apparatus includes the reverse passage to send a recording medium again to a position upstream from the recording heads in the conveyance direction of the recording medium. Specifically, in duplex printing, after an image is formed on a first face of the recording medium by the recording heads, the recording medium is sent from the conveyance belt to the reverse passage and turned around while passing a downstream side of the conveyance belt in the conveyance direction of the recording medium. Then, the recording medium is sent again to a position upstream from the recording heads in the conveyance direction of the recording medium. The reverse passage includes at least the opposite conveyance area of the conveyance belt and the bypass passage. The opposite conveyance area of the conveyance belt moves in a direction opposite a direction in which the normal conveyance area opposing the recording heads moves to convey the recording medium. The bypass passage guides a front edge of the recording medium separated from the opposite conveyance area of the conveyance belt toward the normal conveyance area of the conveyance belt while turning over the recording medium. The charger is disposed between the bypass passage and the outer surface of the conveyance belt. Such a configuration can return the turned recording medium onto the conveyance belt charged by the charger, thus obtaining desired electrostatic adhesion force and allowing stable reverse conveyance.

Figure 4:
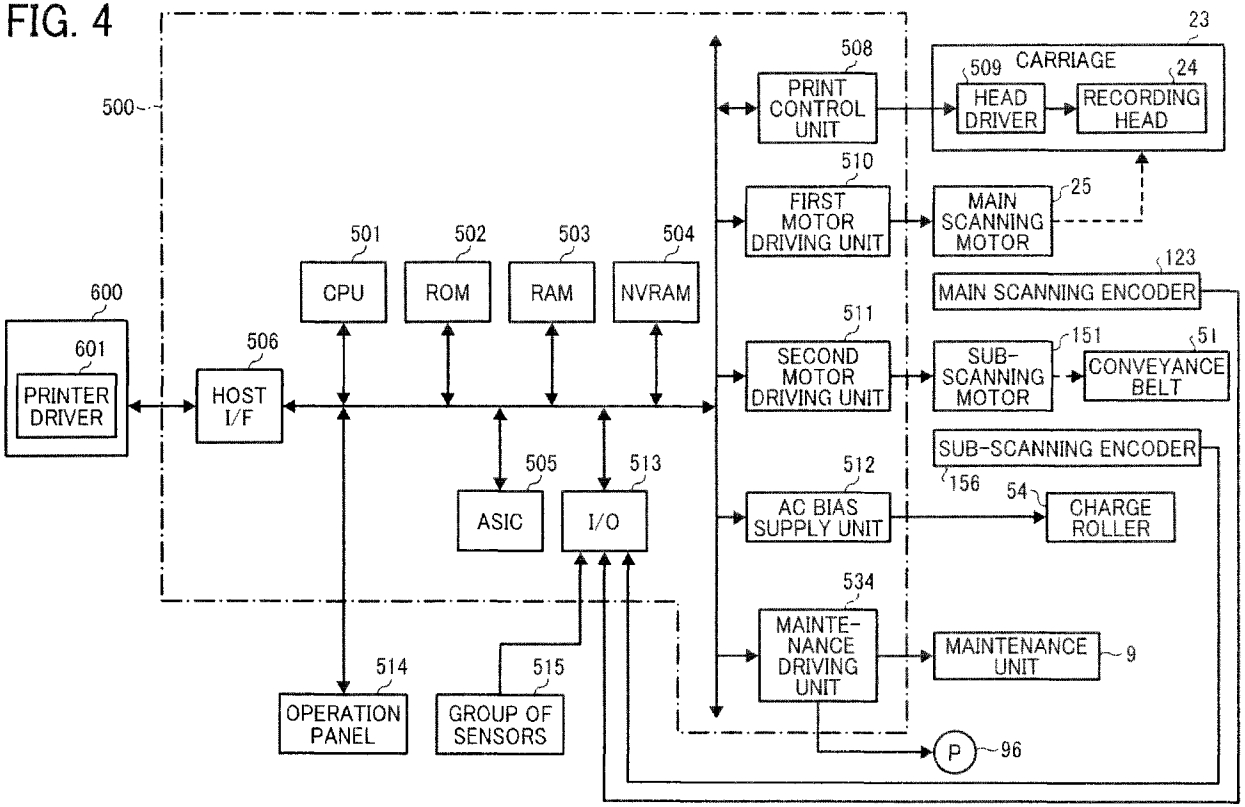
FIG. 4 is a block diagram of a controller of the image forming apparatus.

Next, a controller of the image forming apparatus 1000 is described with reference to FIG. 4.

The controller 500 includes a central processing unit (CPU) 501 to control the entire image forming apparatus, program modules including programs controlling the entire image forming apparatus and causing the CPU 501 to control the charging of the conveyance belt 51, a read-only memory (ROM) 502 to store other non-erasable data, a random access memory (RAM) 503 to temporarily store image data or other data, a rewritable non-volatile memory 504 to retain data even while the apparatus is powered off, and an application specific integrated circuit (ASIC) 505 to process signals for image data, perform image processing, e.g., sorting, or process input and output signals for controlling the entire image forming apparatus.

The controller 500 also has a print control unit 508, including a data transmitter and a driving signal generator, to drive and control the recording heads 24 in accordance with print data, a head driver (driver IC) 509 to drive the recording heads 24 mounted on the carriage 23, a first motor driving unit 510 and a second motor driving unit 511 to drive the main scanning motor 25 for moving the carriage 23 and the sub-scanning motor 151 for circulating the conveyance belt 51, and an alternating current (AC) bias supply unit 512 to supply AC bias to the charge roller 54.

The controller 500 is connected to a control panel 514 for inputting and displaying information necessary to the image forming apparatus.

The controller 500 includes an interface (I/F) 506 for transmitting and receiving data and signals to and from a host 600, such as an information processing device (e.g., personal computer), image reading device (e.g., image scanner), or imaging device (e.g., digital camera) via a cable or network.

The CPU 501 of the controller 500 reads and analyzes print data stored in a reception buffer of the I/F 506, performs desired image processing, data sorting, or other processing with the ASIC 505, and transmits image data from the print control unit 508 to the head driver (driver IC) 509. A printer driver 601 of the host 600 creates dot-pattern data for image output.

The print control unit 508 transmits the above-described image data as serial data and outputs to head driver (driver IC) 509, for example, transfer clock signals, latch signals, control signals required for the transmission of print data and determination of the transmission. The print control unit 508 further includes a driving signal generator including, e.g., a digital/analog (D/A) converter to convert pattern data of driving pulse stored in the ROM 502 from digital to analog, a voltage amplifier, and a current amplifier, to output driving signals of one or more driving pulses to the head driver 509.

In accordance with serially-inputted image data corresponding to one band of a desired image recorded by the recording heads 24, the head driver 509 selectively applies driving pulses constituting driving signals transmitted from the print control unit 508, to driving elements (e.g., piezoelectric elements) for generating energy to eject liquid droplets from the recording heads 24, thus driving the recording heads 24. At this time, by selecting driving pulses constituting driving signals, liquid droplets of different liquid amounts, such as large-size droplets, medium-size droplets, and small-size droplets, can be selectively ejected to form different sizes of dots.

An input/output unit 513 obtains information from the main-scanning encoder 123, the sub scanning encoder 156, and a group of sensors 515 installed in the image forming apparatus, extracts information required for controlling printing operation, and controls the print control unit 508, the first motor driving unit 510, the second motor driving unit 511, and the AC bias supply unit 512 based on the extracted information.

In addition to the above-described registration sensor 160, the reverse sensor 161, and the conveyance sensor 162, the group of sensors 515 further includes, for example, an optical sensor (sheet sensor) 521 (see FIG. 2) disposed at the carriage 23 to detect the position of the sheet, a temperature-and-humidity sensor 531 (see FIG. 1), e.g., a thermistor to monitor the internal temperature and humidity of the image forming apparatus, a voltage sensor to monitor the voltage of the charged conveyance belt, and an interlock switch to detect the opening and closing of a cover. The I/O unit 513 is capable of processing information from such various types of sensors.

For example, the CPU 501 determines a driving output value (control value) for the main scanning motor 25 based on a detected speed value and a detected position value obtained by sampling detected pulses transmitted from the first encoder sensor 122 constituting the main-scanning encoder 123 and a target speed value and a target position value obtained from preliminarily-stored speed and position profiles. Further, based on the driving output value, the CPU 501 drives the main scanning motor 25 via the first motor driving unit 510. Similarly, the CPU 501 determines a driving output value (control value) for the sub scanning motor 151 based on a detected speed value and a detected position value obtained by sampling detected pulses transmitted from the second encoder sensor 155 constituting the sub scanning encoder 156 and a target speed value and a target position value obtained from preliminarily-stored speed and position profiles. Further, based on the driving output value, the CPU 501 drives the sub scanning motor 151 via the second motor driving unit 511.

The controller 500 drives the maintenance unit 9 via a maintenance driving unit 534, moves the cap members 92 back and forth with respect to the nozzle faces 124 of the recording heads 24 to seal and unseal the nozzle faces 124, moves the wiping member 93 to wipe the nozzle faces 124, and drives the suction pump 96 and the air release valve 98 to control maintenance and recovery operation.

Next, a charge pattern of the conveyance belt 51 in the image forming apparatus is described with reference to FIG. 5.

Figure 5:
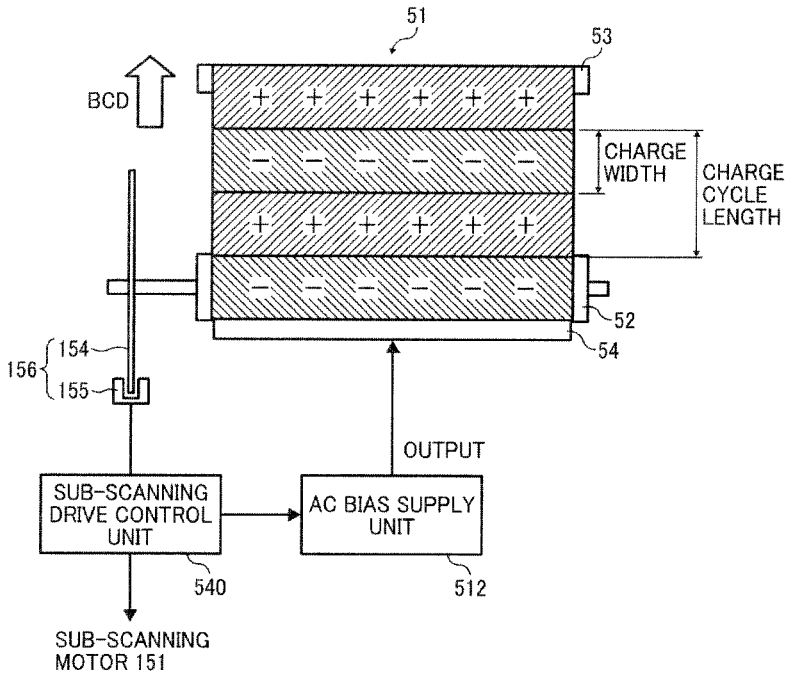
FIG. 5 is a schematic view of a charge pattern of a conveyance belt of the image forming apparatus.

FIG. 5 is a schematic view of an example of the charge pattern. As described above, the rotary encoder 156 detects the rotation amount (e.g., the number of rotations per unit time) with the rotary encoder 156 disposed at an end portion of the conveyance roller 52 for driving the conveyance belt 51, controls the driving of the sub scanning motor 151 via a sub-scanning drive control unit 540 based on the detected rotation amount, and controls the output of the AC bias supply unit 512 for applying AC bias to the charge roller 54.

The AC bias supply unit 512 controls the cycle (applying time) of applied voltage (charge bias) of positive and negative polarities, and simultaneously, the sub-scanning drive control unit 540 controls the driving of the conveyance belt 51, thus allowing electric charge of positive and negative polarities to be applied at desired charge widths on the conveyance belt 51. The term "charge width" used herein, as illustrated in FIG. 5, represents the width of positive or negative polarity in a circulation direction (belt circulation direction) of the conveyance belt 51 indicated by an arrow BCD in FIG. 5, and the term "charge cycle length" represents the width (distance) of one cycle of applied voltage of positive and negative polarities in the sheet conveyance direction.

As described above, charge areas of positive and negative polarities are alternately formed in the sheet conveyance direction on the outer surface of the conveyance belt 51, thus generating nonuniform electric field on the conveyance belt 51. When the sheet 10 is sent onto the conveyance belt 51 having such nonuniform electric field, the sheet 10 is immediately polarized along the direction of electric field. The nonuniform electric field increases the density of electric charges of a face of the sheet 11 opposing the outer surface of the conveyance belt 51 to attract the conveyance belt 51 while reducing the density of electric charges of the opposite face of the sheet 11 to repel the conveyance belt 51. The difference in electric charges causes the sheet 10 to be immediately adhered to the conveyance belt 51.

Figure 6:
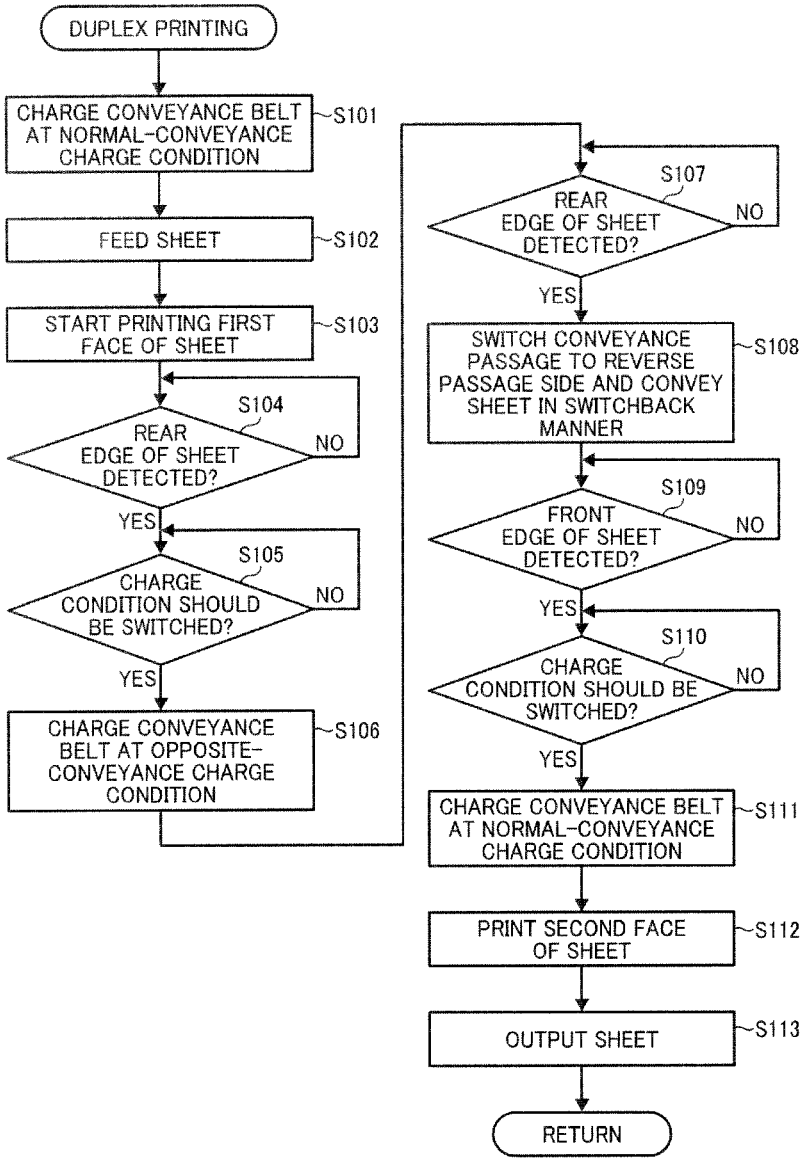
FIG. 6 is a flowchart of a procedure of duplex printing control performed by the controller.

Next, duplex printing control of the controller is described with respect to FIG. 6.

At S101, the conveyance belt 51 is charged at a predetermined charge condition for normal conveyance (hereinafter, normal-conveyance charge condition). The term "normal-conveyance charge condition" is a charge condition used when the sheet 10 is conveyed with the sheet 10 adhered to the normal conveyance area 51*a* of the conveyance belt 51 and opposing the recording heads 24. The normal-conveyance charge condition, as described below, is a charge condition capable of minimizing occurrence of mist due to electric field created between the conveyed sheet 10 and the recording heads 24 and obtaining a desired electrostatic adhesion force.

At S102, the sheet 10 is fed from the sheet feed tray 4 and the front edge of the sheet 10 is detected with the registration sensor 160. Synchronizing the conveyance of the sheet 10 with the scanning of the carriage 23 of the image forming section 2, the sheet 10 is conveyed with the sheet 10 adhered to the conveyance belt 51 by electrostatic force. Meanwhile, as described above, at S103 liquid droplets are ejected from the recording heads 24 to form a desired image on a first face (first image formation face) of the sheet 10.

At this time, in a case in which duplex printing is performed, when the registration sensor 160 detects the rear edge of the sheet 10 (YES at S104), the charging at the normal-conveyance charge condition is continued until the rear edge of the sheet 10 is adhered to the normal conveyance area 51*a* of the conveyance belt 51. When the rear edge of the sheet 10 is attached onto the normal conveyance area 51*a* of the conveyance belt 51, it is determined to be a timing (charge-condition switch timing) in which the charge condition should be switched (YES at S105) and at S106 the conveyance belt 51 is charged at a charge condition for opposite conveyance (hereinafter, opposite-conveyance charge condition).

The term "opposite-conveyance charge condition" used herein is a charge condition used when the sheet 10 is conveyed in the switchback manner with the sheet 10 adhered to the opposite conveyance area 51*b* of the conveyance belt 51. The opposite-conveyance charge condition, as described below, is a charge condition capable of obtaining greater electrostatic adhesion force than in normal conveyance because there is no occurrence of mist due to electric field created between the conveyed sheet 10 and the recording heads 24.

In this case, the switching from the normal-conveyance charge condition to the opposite-conveyance charge condition is preferably performed at a timing at which a portion of the conveyance belt 51 charged at the opposite-conveyance charge condition arrives at the scanning area of the recording heads 24 after the printing of the first face of the sheet 10 is completed and the carriage 23 is retreated to the home position (opposing the maintenance unit 9). In other words, in the opposite-conveyance charge condition, to obtain an electrostatic adhesion force greater than that of the normal-conveyance charge condition, the portion of the conveyance belt 51 charged at the opposite-conveyance charge condition does not oppose the recording heads 24, thus reducing the influence of the charging. In addition, if an area of the conveyance belt 51 just behind the rear edge of the sheet 10 adhered to the conveyance belt 51 is charged at the opposite-conveyance charge condition, more ink mist tend to adhere to the conveyance belt 51 because more ink mist is floating in the air just after printing. Hence, the switching from the normal-conveyance charge condition to the opposite-conveyance charge condition may be delayed, thus reducing the adherence of mist to the conveyance belt 51.

Meanwhile, the sheet 10 having the image on the first face is sent toward the sheet output tray 7 via the sheet output passage 60. When the rear edge of the sheet 10 passes the switching claw 81 and is detected with the reverse sensor 161 (YES at S107), at S108 the position of the switching claw 81 is changed to switch the conveyance passage of the sheet 10 from the sheet output passage 60 to the reverse passage 80.

The sheet output roller 64 is rotated in reverse to convey the sheet 10 having the image on the first face toward the reverse passage 80 in the switchback manner.

Thus, the sheet 10 is turned around, conveyed along the reverse-conveyance guide member 82, and sent onto the opposite conveyance area 51*b* of the conveyance belt 51. Further, the sheet 10 is sent into between the opposite conveyance area 51*b* of the conveyance belt 51 and the auxiliary conveyance roller 85, reliably adhered to the opposite conveyance area 51*b*, and conveyed in the opposite conveyance direction.

When the conveyance sensor 162 detects the front edge of the sheet 10 conveyed in the opposite direction (YES at S109), at S110 it is determined whether it is a timing (charge-condition switch timing) at which the charge condition should be switched. In synchronized with a timing at which the sheet 10 is adhered again to the normal conveyance area 51*a* of the conveyance belt 51 via the bypass passage 86 after the detection of the front edge of the sheet 10, at S111 the charge condition of the conveyance belt 51 is switched from the opposite-conveyance charge condition to the normal-conveyance charge condition and the conveyance belt 51 is charged at the normal-conveyance charge condition.

Thus, the sheet 10 is sent from the opposite conveyance area 51*b* via the bypass passage 86 to the normal conveyance area 51*a* and adhered again to the normal conveyance area 51*a* at the position upstream from the regulation roller 48. Further, the sheet 10 is conveyed in the normal conveyance direction and at 112 the recording heads 24 form an image on a second face of the sheet 10. At S113, the sheet having the images on the first and second faces is output to the sheet output tray 7.

In addition, as described above, if an area of the conveyance belt 51 just behind the rear edge of the sheet 10 adhered to the conveyance belt 51 is charged at the opposite-conveyance charge condition, more ink mist tends to adhere to the conveyance belt 51 because more ink mist is floating in the air just after printing. Hence, charging may be stopped between the area of the conveyance belt 51 to which the sheet 10 is adhered during the first-face printing and the opposite conveyance area 51*b* to which the sheet 10 turned in the switchback manner is adhered again. The image forming apparatus 1000 also has an ink collection device including, e.g., a filter and a fan, to collect mist floating near the conveyance belt 51 while the conveyance belt 51 is not charged, thus reducing the amount of mist adhered to the conveyance belt 51.

Next, the normal-conveyance charge condition and the opposite-conveyance charge condition of the conveyance belt are described with reference to Table 1 and FIG. 7.

TABLE 1

| CHARGE WIDTH (mm) | ADHESION FORCE (N) |
|---|---|
| 2.4 | 11.5 |
| 4 | 22.2 |
| 8 | 35.0 |
| 16 | 47.0 |

Table 1 shows relationship between the charge width of the conveyance belt and the force (sheet adhesion force) by which the sheet is adhered to the conveyance belt. FIG. 7 is a graph chart showing the relationship of Table 1.

Figure 7:
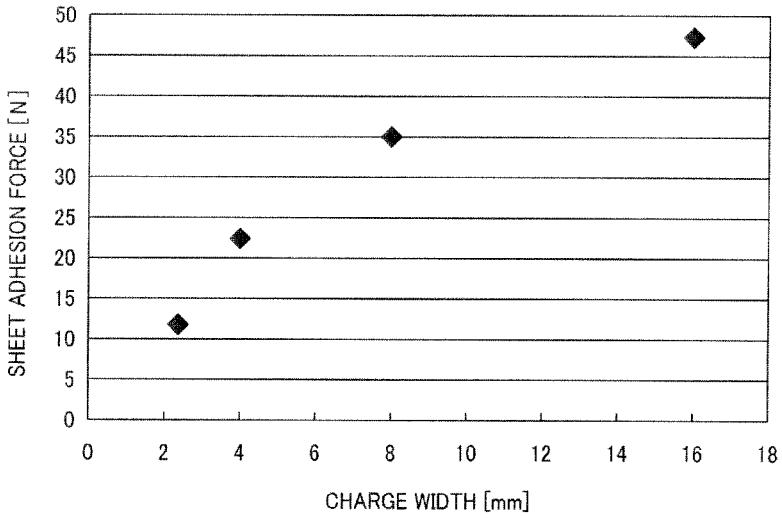
FIG. 7 is a graph chart of the relationship between the charge width and sheet adhesion force of the conveyance belt shown in Table 1.

As illustrated in Table 1 and FIG. 7, as the charge width of the conveyance belt 51 increases, the sheet adhesion force of the conveyance belt 51 increases. On the other hand, as the charge width increases (i.e., the sheet adhesion force increases), when liquid droplets are ejected from the recording heads 24 to form an image, liquid droplets are affected by the electric field created between the sheet 10 and the recording heads 24 during conveyance of the sheet 10. As a result, the amount of ink mist tends to increase.

Hence, in this exemplary embodiment, when (where) the sheet 10 is adhered to the normal conveyance area 51*a* of the conveyance belt 51 for image formation, the charge width of the conveyance belt 51 is narrowed to minimize the occurrence of ink mist. By contrast, when (where) the sheet 10 turned around is adhered to the opposite conveyance area 51*b* of the conveyance belt 51, the charge width of the conveyance belt 51 is widened to enhance the sheet adhesion force because there is no influence of such electric field created between the sheet 10 and the recording heads 24.

For example, for the normal-conveyance charge condition, the conveyance belt 51 is charged at a charge width L1 to minimize the occurrence of mist and obtain a large sheet adhesion force. By contrast, for the opposite-conveyance charge condition, the conveyance belt 51 is charged at a charge width L2 (L2>L1) greater than the charge width L1 to obtain a sheet adhesion force higher than that obtained at the normal-conveyance charge condition.

As described above, the reverse passage includes at least the opposite conveyance area of the conveyance belt that moves in a direction opposite a direction in which the normal conveyance area of the conveyance belt opposing the recording heads moves to convey the recording medium. The charge width of the reverse conveyance area (opposite conveyance area) and the charge width of the recording area (normal conveyance area) are set separately, and charge control is performed to charge the conveyance belt at a charge condition so that the adhesion force of the recording medium in the opposite conveyance area of the conveyance belt is greater than the normal conveyance area. Such a configuration can increase the conveyance force (adhesion force) in the reverse conveyance while minimizing the occurrence of ink mist, thus enhancing the performance of reverse conveyance (achieving stable reverse conveyance).

Because the sheet adhesion force of the conveyance belt varies with charge potential as well as charge width, the charge potential of the opposite conveyance area and the charge potential of the recording area may be separately set, thus obtaining effects equivalent to those obtained when the charge width of the opposite conveyance area and the charge width of the recording area are set separately.

Next, relationship among temperature, humidity, and the charge width of the conveyance belt is described with reference to Table 2 and 3.

TABLE 2

| | | Temperature (t) | | | | | | |
|---|---|---|---|---|---|---|---|---|
| | | t < 10° C. | 10° C. ≤ t < 15° C. | 15° C. ≤ t < 20° C. | 20° C. ≤ t < 25° C. | 25° C. ≤ t < 30° C. | 30° C. ≤ t < 35° C. | 35° C. ≤ t |
| Humidity (h) | h < 10% | 2 mm | 2 mm | 2 mm | 2 mm | 4 mm | 4 mm | 4 mm |
| | 10% ≤ h < 25% | 2 mm | 2 mm | 2 mm | 4 mm | 4 mm | 4 mm | 4 mm |
| | 25% ≤ h < 35% | 2 mm | 2 mm | 4 mm | 4 mm | 4 mm | 4 mm | 8 mm |
| | 35% ≤ h < 45% | 2 mm | 4 mm | 4 mm | 4 mm | 4 mm | 8 mm | 8 mm |
| | 45% ≤ h < 55% | 4 mm | 4 mm | 4 mm | 4 mm | 8 mm | 8 mm | 8 mm |
| | 55% ≤ h < 65% | 4 mm | 4 mm | 4 mm | 8 mm | 8 mm | 8 mm | 12 mm |
| | 65% ≤ h < 75% | 4 mm | 4 mm | 8 mm | 8 mm | 8 mm | 12 mm | 12 mm |
| | 75% ≤ h | 4 mm | 4 mm | 8 mm | 8 mm | 12 mm | 12 mm | 12 mm |

TABLE 3

| | | Temperature (t) | | | | | | |
|---|---|---|---|---|---|---|---|---|
| | | t < 10° C. | 10° C. ≤ t < 15° C. | 15° C. ≤ t < 20° C. | 20° C. ≤ t < 25° C. | 25° C. ≤ t < 30° C. | 30° C. ≤ t < 35° C. | 35° C. ≤ t |
| Humidity (h) | h < 10% | 6 mm | 6 mm | 6 mm | 6 mm | 8 mm | 8 mm | 8 mm |
| | 10% ≤ h < 25% | 6 mm | 6 mm | 6 mm | 8 mm | 8 mm | 8 mm | 4 mm |
| | 25% ≤ h < 35% | 6 mm | 6 mm | 8 mm | 8 mm | 8 mm | 4 mm | 12 mm |
| | 35% ≤ h < 45% | 6 mm | 8 mm | 8 mm | 8 mm | 8 mm | 12 mm | 12 mm |
| | 45% ≤ h < 55% | 8 mm | 8 mm | 8 mm | 8 mm | 12 mm | 12 mm | 12 mm |
| | 55% ≤ h < 65% | 8 mm | 8 mm | 8 mm | 12 mm | 12 mm | 12 mm | 16 mm |
| | 65% ≤ h < 75% | 8 mm | 8 mm | 12 mm | 12 mm | 12 mm | 16 mm | 16 mm |
| | 75% ≤ h | 8 mm | 8 mm | 12 mm | 12 mm | 16 mm | 16 mm | 16 mm |

The sheet adhesion force of the conveyance belt 51 varies with ambient temperature and humidity. In other words, as ambient temperature increases, the adhesion force tends to decrease. Alternatively, as ambient humidity increases, the adhesion force also tends to decrease.

Hence, in this exemplary embodiment, the charge width is controlled based on the temperature and humidity detected with the temperature-and-humidity sensor 531 of the group of sensors 515 and a table containing information on charge widths of the recording area (the normal conveyance area 51*a*) and charge widths of the reverse conveyance area (the opposite conveyance area 51*b*) defined with respect to predetermined sets of temperature and humidity.

Such a configuration can optimize the charge condition according to the environment in which the image forming apparatus is used, and increase the conveyance force in reverse conveyance while minimizing the occurrence of ink mist, thus enhancing the performance of reverse conveyance.

Next, a second exemplary embodiment of the present disclosure is described with reference to FIG. 8.

Figure 8:
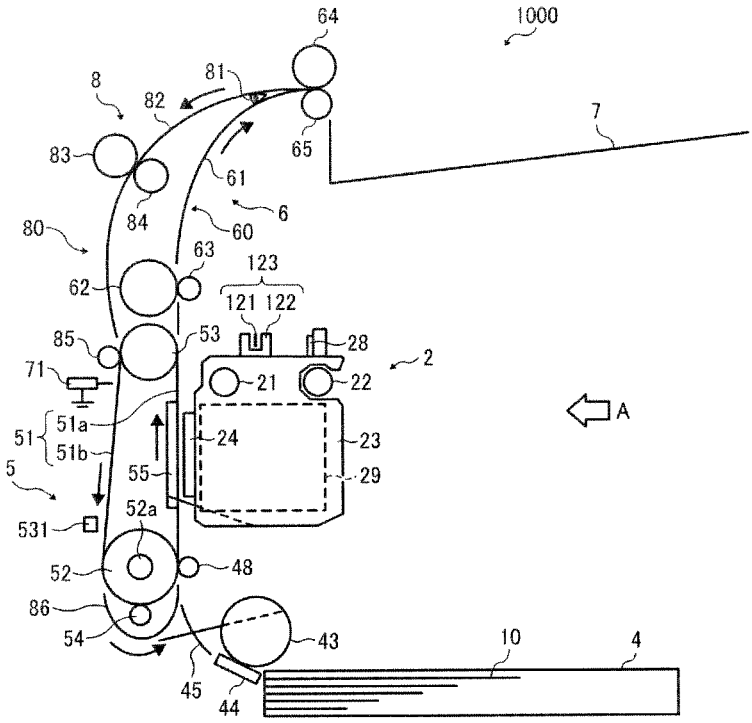
FIG. 8 is a side view of a mechanical section of an image forming apparatus according to a second exemplary embodiment.

FIG. 8 is a side view of a mechanical section of an image forming apparatus according to the second exemplary embodiment.

In this exemplary embodiment, the image forming apparatus 1000 includes a discharging brush 71 serving as a discharger to remove charges from a surface of the sheet 10 adhered to the opposite conveyance area 51*b* of the conveyance belt 51. The discharging brush 71 is earthed. The discharger is not limited to such brush type and may be, for example, a needle- or roller-type discharger.

Thus, after the sheet 10 is adhered to the conveyance belt 51, electric charges on the surface of the sheet 10 are removed by the discharging brush 71, increasing the sheet adhesion force. As a result, the conveyance force in reverse conveyance is increased, thus enhancing the performance of reverse conveyance.

Next, a third exemplary embodiment of the present disclosure is described with reference to FIG. 9.

Figure 9:
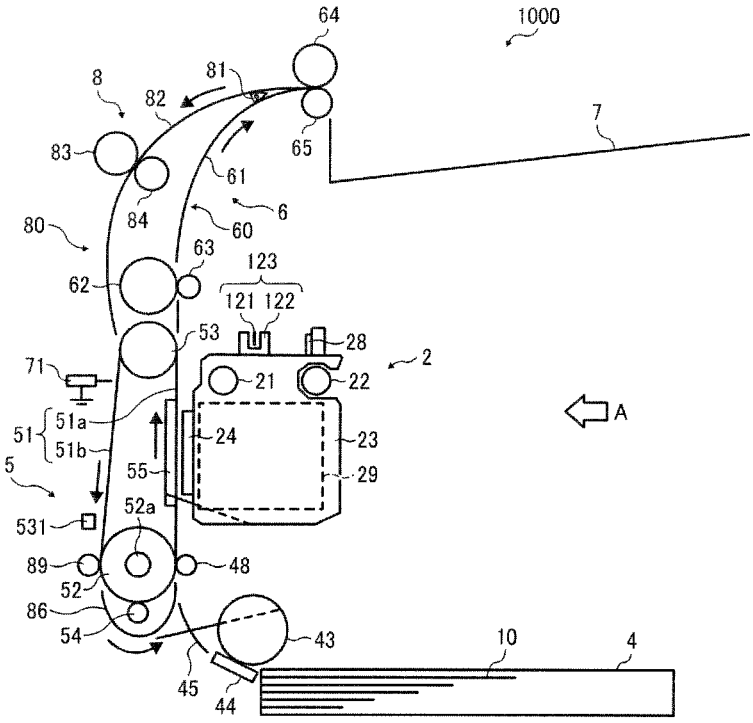
FIG. 9 is a side view of a mechanical section of an image forming apparatus according to a third exemplary embodiment.

FIG. 9 is a side view of a mechanical section of an image forming apparatus according to the third exemplary embodiment.

This exemplary embodiment differs from the second exemplary embodiment illustrated in FIG. 8 in that an auxiliary conveyance roller 89 is disposed at an entry area to the bypass passage 86 of the reverse passage 80 so as to contact the outer surface of the conveyance belt 51. The auxiliary conveyance roller 89 is disposed opposing the conveyance roller 52, urged (pressed) toward the conveyance roller 52, and rotated by the rotation of the conveyance roller 52 (the conveyance belt 51) to generate assistive conveyance force.

As described above, by disposing the auxiliary conveyance roller 89 at the side of the conveyance roller 52, assistive conveyance force can be obtained without affecting the tension of the conveyance belt 51.

Next, a fourth exemplary embodiment of the present disclosure is described with reference to FIGS. 10 and 11.

Figure 10:
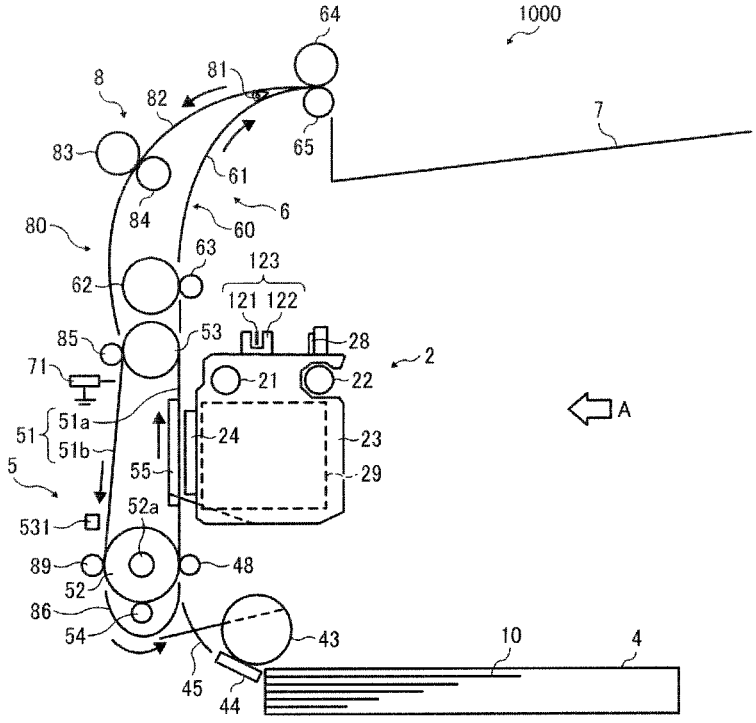
FIG. 10 is a side view of a mechanical section of an image forming apparatus according to a fourth exemplary embodiment.

FIG. 10 is a side view of a mechanical section of an image forming apparatus according to the fourth exemplary embodiment. FIG. 11 is an enlarged view of a portion of the mechanical section of FIG. 10.

This exemplary embodiment differs from the third exemplary embodiment illustrated in FIG. 9 in which, as with the first exemplary embodiment illustrated in FIG. 1, an auxiliary conveyance roller 85 made of, e.g., ethylene propylene (EP) rubber is disposed opposing the driven roller 53.

The auxiliary conveyance roller 85 assists the conveyance force for conveying the sheet 10 in the sheet reverse section 8 and the re-adhesion of the sheet 10 to the opposite conveyance area 51*b* of the conveyance belt 51. Although the press roller 48 is disposed near the normal conveyance area 51*a* of the conveyance belt 51, sheet feeding is controlled by an encoder sheet mounted to the conveyance roller 52. Accordingly, if the sheet 10 slips at a nipping portion between the conveyance belt 51 and the press roller 48, the accuracy of sheet feeding may be reduced. Hence, in this exemplary embodiment, the contact pressure of the auxiliary conveyance roller 85 against the conveyance belt 51 is set lower than the contact pressure of the press roller 48 against the conveyance belt 51.

Figure 11:
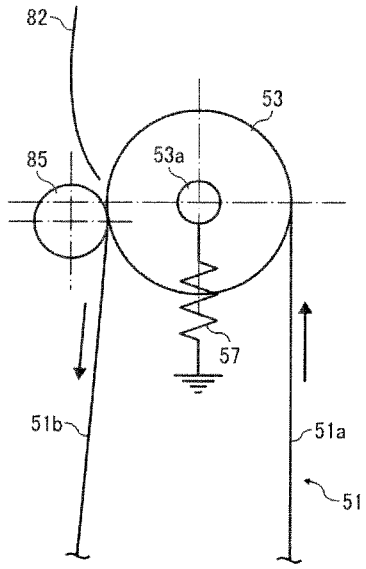
FIG. 11 is an enlarged view of a portion of the mechanical section illustrated in FIG. 10.

As illustrated in FIG. 11, with respect to a position in a pressing direction of a press spring 57, i.e., a direction in which the press spring 57 applies tension to the driven roller 53 so that the driven roller 53 moves away from the conveyance roller 52, the center of axis of the auxiliary conveyance roller 85 is disposed downstream from (in FIG. 11, lower than) the center of axis of the driven roller 53 in the traveling direction of the conveyance belt 51.

The position of the driven roller 53 is adjustable in accordance with the tension applied by the press spring 57. In this case, if the auxiliary conveyance roller 85 is disposed with the auxiliary conveyance roller 85 pressed against the driven roller 53, movement of the driven roller 53 may be restricted. As a result, the tension of the conveyance belt 51 may vary, thus affecting the accuracy of sheet feeding. Therefore, in view of the assistive conveyance force, it is preferable to dispose the auxiliary conveyance roller 89 at the side of the conveyance roller 52 as described in the third exemplary embodiment.

Hence, in this exemplary embodiment, the center of rotation axis of the auxiliary conveyance roller 85 is disposed downstream from (lower than, in FIG. 11) the center of rotation axis of the driven roller 53 in the traveling direction of the conveyance belt 51. In other words, a press point of the auxiliary conveyance roller 85 against the conveyance belt 51 (a point of the conveyance belt 51 on which the pressure from the auxiliary conveyance roller 85 acts) is located downstream from (lower than, in FIG. 11) the center of rotation axis of the driven roller 53 in the traveling direction of the conveyance belt 51.

Accordingly, in the case in which the auxiliary conveyance roller 85 is disposed at the side of the driven roller 53 with the auxiliary conveyance roller 85 pressed against the driven roller 53, the pressure from the auxiliary conveyance roller 85 is broken into a first direction in which the driven roller 53 is pressed by the auxiliary conveyance roller 85 and a second direction perpendicular to the first direction. As a result, the pressure of the press spring 57 against the driven roller 53, i.e., the tension applied to the driven roller 53 is not affected by the pressure from the auxiliary conveyance roller 85 against the driven roller 53.

By contrast, in a case in which the center of rotation axis of the auxiliary conveyance roller 85 is located upstream from (higher than, in FIG. 11) the center of rotation axis of the driven roller 53, which receives the pressure from the press spring 57, in the traveling direction of the conveyance belt 51, the pressure from the auxiliary conveyance roller 85 is broken into a direction to reduce the tension of the driven roller 53, thus loosening the conveyance belt 51.

As described above, in this exemplary embodiment, the press point of the auxiliary conveyance roller 85 against the conveyance belt 51 is located downstream from the center of axis of the driven roller 53 in the traveling direction of the conveyance belt 51. Such a configuration can obtain assistive conveyance force without affecting the accuracy of sheet feeding.

Next, a shape of the auxiliary conveyance roller 85 and a method of adhering a front edge of the sheet is described with reference to FIG. 12.

Figure 12:
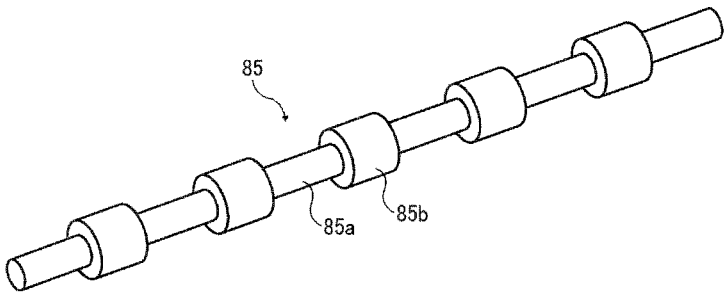
FIG. 12 is a perspective view of an example of an auxiliary conveyance roller.

In FIG. 12, the auxiliary conveyance roller 85 has a segmented roller shape in which multiple rubber roller portions 85*b* are mounted around a shaft 85*a*. Alternatively, the auxiliary conveyance roller 85 may have a non-segmented roller around the shaft 85.

In the case in which the auxiliary conveyance roller 85 has the segmented roller shape and the conveyance belt 51 against which the auxiliary conveyance roller 85 is pressed wraps around the driven roller 53 of flat shape, if the front edge of the sheet 10 hits against the auxiliary conveyance roller 85 and is guided into a nipping portion between the auxiliary conveyance roller 85 and the conveyance belt 51, the sheet 10 may be deformed in a wavy shape between the rubber roller portions 85*b*.

Hence, in this exemplary embodiment, the front edge of the sheet 10 is hit against the conveyance belt 51 by the reverse-conveyance guide member 82 and guided to the nipping portion between the auxiliary conveyance roller 85 and the conveyance belt 51. Such a configuration prevents such wavy deformation of the sheet 10, thus allowing stable sheet adhesion on the conveyance belt 51.

The above-described exemplary embodiments are described taking the example of the configuration in which liquid droplets are ejected to a sheet in the horizontal direction while the sheet is conveyed in the vertical (upright) direction. Alternatively, for example, another configuration may be employed in which liquid droplets are ejected to a sheet in a direction inclined relative to the horizontal direction while the sheet is conveyed in a direction inclined relative to the vertical (upright) direction.

In the above-described exemplary embodiment, the image forming apparatus is a serial-type image forming apparatus. However, the image forming apparatus is not limited to a serial-type image forming apparatus and may be, for example, a full-line-type image forming apparatus.

In the above-described exemplary embodiment, the image forming apparatus has the configuration in which liquid droplets are ejected to a sheet in the horizontal direction while the sheet is conveyed in the vertical (upright) direction. However, the configuration of the image forming apparatus is not limited to the configuration and may be, for example, a configuration in which liquid droplets are ejected to a sheet in the vertical (upright) direction or a direction inclined relative to the vertical direction while the sheet is conveyed in the horizontal direction or a direction inclined relative to the horizontal direction.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head having a nozzle face in which nozzles to eject liquid droplets are disposed;

a conveyance belt looped around at least two rollers to adhere a recording medium thereto by electrostatic force and convey the recording medium, the conveyance belt defining a normal conveyance area in which the recording medium is conveyed in a first conveyance direction with the recording medium facing the recording head, the at least two rollers including a driving roller and a tensioned driven roller disposed to apply a tension force in a tension direction to the conveyance belt:

a charger to charge a surface of the conveyance belt;

a reverse passage to deliver the recording medium turned around in an area downstream from the conveyance belt in the first conveyance direction after the recording head forms an image on a first face of the recording medium in duplex printing and to send the recording medium back again to a portion of the conveyance belt upstream from the recording head in the first conveyance direction, the reverse passage including an opposite conveyance area of the conveyance belt in which the recording medium is conveyed in a second conveyance direction opposite the first conveyance direction;

an auxiliary conveyance roller disposed at least one of an entry part and an exit part of the opposite conveyance area of the conveyance belt; and a conveyance guide member having a curved end portion to guide the recording medium in a sheet guide direction that crosses the second conveyance direction of the opposite conveyance area of the conveyance belt at an angle tilted relative to the second conveyance direction, so that a front end of the recording medium hits against the conveyance belt at a position near a nipping portion between the auxiliary conveyance roller and the driven roller, the position near the nipping portion being upstream from e nipping portion in the second conveyance direction of the opposite conveyance area, wherein the auxiliary conveyance roller is disposed opposing and pressed toward the driven roller at the entry part of the opposite conveyance area, and a center of rotation axis of the auxiliary conveyance roller at the entry part of the opposite conveyance area is disposed downstream from a center of rotation axis of the driven roller in a direction in which the recording medium is conveyed along the reverse passage, and wherein the center of rotation axis of the auxiliary conveyance roller and the center of rotation axis of the driven roller are offset from each other so as not to be aligned on a straight line perpendicular to the tension direction of the driven roller.

2. The image forming apparatus according to claim 1, wherein the auxiliary conveyance roller has multiple roller portions segmented in an axial direction of the auxiliary conveyance roller perpendicular to the second conveyance direction of the recording medium.

3. The image forming apparatus according to claim 1, wherein the nozzle face of the recording head in which the nozzles are formed is disposed in a vertical direction or obliquely to the vertical direction, the recording head ejects the liquid droplets in a horizontal direction or obliquely to the horizontal direction, and the conveyance belt conveys the recording medium in the vertical direction or obliquely to the vertical direction with the recording medium facing the recording head.

4. The image forming apparatus according to claim 1, further comprising a controller to control the charger, wherein, when the charger charges the conveyance belt, an adhesion force of the opposite conveyance area for the recording medium becomes greater than an adhesion force of the normal conveyance area for the recording medium.

5. The image forming apparatus according to claim 1, further comprising a press roller disposed opposing one of the at least two rollers at a portion of the normal conveyance area upstream from the recording head in the first conveyance direction, wherein a contact pressure of the auxiliary conveyance roller against the conveyance belt is lower than a contact pressure of the press roller against the conveyance belt.

6. The image forming apparatus according to claim 1, wherein the center of axis of the auxiliary conveyance roller is disposed downstream from the center of axis of the driven roller in the traveling direction of the conveyance belt.

7. The image forming apparatus according to claim 1, wherein the normal conveyance area of the conveyance belt is an area from the driving roller to the driven roller that faces the recording head to convey the recording medium in the first conveyance direction, and the opposite conveyance area is an area from the driven roller to the driving roller and is disposed opposing the normal conveyance area to convey the recording medium in the second conveyance direction opposite the normal conveyance direction.

* * * * *